US009745830B2

(12) United States Patent
Lake

(10) Patent No.: US 9,745,830 B2
(45) Date of Patent: Aug. 29, 2017

(54) FAILSAFE SUBSURFACE CONTROLLED SAFETY VALVE

(71) Applicant: Weatherford Technology Holdings, LLC, Houston, TX (US)

(72) Inventor: Gary Benjamin Lake, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 14/887,196

(22) Filed: Oct. 19, 2015

(65) Prior Publication Data

US 2016/0108701 A1 Apr. 21, 2016

Related U.S. Application Data

(60) Provisional application No. 62/066,139, filed on Oct. 20, 2014.

(51) Int. Cl.

| | |
|---|---|
| ***E21B 34/14*** | (2006.01) |
| ***E21B 34/10*** | (2006.01) |
| ***E21B 34/08*** | (2006.01) |
| *E21B 34/00* | (2006.01) |

(52) U.S. Cl.

CPC ..... *E21B 34/14* (2013.01); *E21B 34/08* (2013.01); *E21B 34/10* (2013.01); *E21B 34/102* (2013.01); *E21B 2034/005* (2013.01)

(58) Field of Classification Search

CPC ..... E21B 34/14; E21B 34/08; E21B 34/10; E21B 34/102

See application file for complete search history.

(56) References Cited

U.S. PATENT DOCUMENTS

| | | | | |
|---|---|---|---|---|
| 3,724,475 | A * | 4/1973 | Ruppel | E21B 34/08 137/498 |
| 3,749,119 | A * | 7/1973 | Tausch | E21B 34/08 137/461 |
| 3,860,066 | A * | 1/1975 | Pearce | E21B 34/08 137/458 |
| 4,161,219 | A * | 7/1979 | Pringle | E21B 34/10 166/324 |
| 4,161,960 | A * | 7/1979 | Watkins | E21B 34/08 137/458 |
| 4,276,937 | A * | 7/1981 | Calhoun | E21B 23/006 166/323 |
| 4,621,695 | A * | 11/1986 | Pringle | E21B 34/10 166/321 |
| 5,176,220 | A | 1/1993 | Akkerman | |
| 7,246,668 | B2 | 7/2007 | Smith | |
| 7,392,849 | B2 | 7/2008 | Lauderdale et al. | |

(Continued)

*Primary Examiner* — Matthew R Buck
*Assistant Examiner* — Aaron Lembo
(74) *Attorney, Agent, or Firm* — Patterson & Sheridan, LLP

(57) ABSTRACT

Embodiments of the invention generally relate to a failsafe subsurface controlled safety valve. In one embodiment, a failsafe subsurface controlled safety valve assembly includes: a tubular housing; a closure member disposed in the tubular housing, wherein the closure member is movable between a closed position and an open position; an operating piston operable to move the closure member between the closed position and the open position; and a trigger piston operable to move the closure member from the open position to the closed position.

24 Claims, 10 Drawing Sheets

(56) References Cited

U.S. PATENT DOCUMENTS

| | | | | |
|---|---|---|---|---|
| 7,654,333 | B2 | 2/2010 | Smith | |
| 7,694,742 | B2 | 4/2010 | Bane et al. | |
| 8,616,291 | B2 | 12/2013 | Smith et al. | |
| 9,145,757 | B2 | 9/2015 | Williams | |
| 2016/0108701 | A1* | 4/2016 | Lake | E21B 34/08<br>166/374 |
| 2016/0265309 | A1* | 9/2016 | Vick, Jr. | E21B 34/10 |

* cited by examiner

1

32
22
24
21
26
23
28
29
27
33g
33
33h
33c
34
20
1
31
30
15
10

FAILSAFE SUBSURFACE CONTROLLED SAFETY VALVE

BACKGROUND OF THE DISCLOSURE

Field of the Disclosure

The present disclosure generally relates to a failsafe subsurface controlled safety valve.

Description of the Related Art

FIGS. 1A-1C illustrate a prior art completed subsea well. A conductor string 3 may be driven into a floor 1*f* of the sea 1. The conductor string 3 may include a housing 3*h* and joints of conductor pipe 3*p* connected together, such as by threaded connections. Once the conductor string 3 has been set, a subsea wellbore 2 may be drilled into the seafloor 1*f* and extend into one or more upper formations 9*u*. A surface casing string 4 may be deployed into the wellbore 3. The surface casing string 4 may include a wellhead housing 4*h* and joints of casing 4*c* connected together, such as by threaded connections. The wellhead housing 4*h* may land in the conductor housing 3*h* during deployment of the surface casing string 4. The surface casing string 4 may be cemented 8*s* into the wellbore 2. Once the surface casing string 2 has been set, the wellbore 2 may be extended and an intermediate casing string 5 may be deployed into the wellbore. The intermediate casing string 5 may include a hanger 5*h* and joints of casing 5*c* connected together, such as by threaded connections. The intermediate casing string 5 may be cemented 8*i* into the wellbore 2.

Once the intermediate casing string 5 has been set, the wellbore 2 may be extended into and a hydrocarbon-bearing (i.e., crude oil and/or natural gas) reservoir 9*r*. The production casing string 6 may be deployed into the wellbore. The production casing string 6 may include a hanger 6*h* and joints of casing 6*c* connected together, such as by threaded connections. The production casing string 6 may be cemented 8*p* into the wellbore 2. Each casing hanger 5*h*, 6*h* may be sealed in the wellhead housing 4*h* by a packoff. The housings 3*h*, 4*h* and hangers 5*h*, 6*h* may be collectively referred to as a wellhead 10.

A production tree 15 may be connected to the wellhead 10, such as by a tree connector 13. The tree connector 13 may include a fastener, such as dogs, for fastening the tree to an external profile of the wellhead 10. The tree connector 13 may further include a hydraulic actuator and an interface, such as a hot stab, so that a remotely operated subsea vehicle (ROV) 20 (FIG. 2A) may operate the actuator for engaging the dogs with the external profile. The tree 15 may be vertical or horizontal. If the tree is vertical (not shown), it may be installed after a production tubing string 7 is hung from the wellhead 10. If the tree 15 is horizontal (as shown), the tree may be installed and then the production tubing string 7 may be hung from the tree 15. The tree 15 may include fittings and valves to control production from the wellbore 2 into a pipeline (not shown) which may lead to a production facility (not shown), such as a production vessel or platform.

The production tubing string 7 may include a hanger 7*h* and joints of production tubing 7*t* connected together, such as by threaded connections. The production tubing string 7 may further include a subsurface safety valve (SSV) 7*v* interconnected with the tubing joints 7*t* and a hydraulic conduit 7*c* extending from the valve 7*v* to the hanger 7*h*. The production tubing string 7 may further include a production packer 7*p* and the packer may be set between a lower end of the production tubing and the production casing string 6 to isolate an annulus 7*a* formed therebetween from production fluid 9*f* (FIG. 3A). The tree 15 may also be in fluid communication with the hydraulic conduit 7*c*. A lower end of the production casing string 6 may be perforated 11 to provide fluid communication between the reservoir 9*r* and a bore of the production tubing string 7. The production tubing string 7 may transport the production fluid 9*f* from the reservoir 9*r* to the production tree 15.

The tree 15 may include a head 12, the tubing hanger 7*h*, the tree connector 13, an internal cap 14, an external cap 16, an upper crown plug 17*u*, a lower crown plug 17*b*, a production valve 18*p*, one or more annulus valves 18*u,b*, and a face seal 19. The tree head 12, tubing hanger 7*h*, and internal cap 14 may each have a longitudinal bore extending therethrough. The tubing hanger 7*h* and head 12 may each have a lateral production passage formed through walls thereof for the flow of the production fluid 9*f*. The tubing hanger 7*h* may be disposed in the head bore. The tubing hanger 7*h* may be fastened to the head by a latch.

Typical deepwater SSVs 7*v* are part of the production tubing string 7 and include a nitrogen chamber as part of the closure mechanism. Should the nitrogen leak from the chamber, the SSV 7*v* will no longer close and the production tubing string 7 must be pulled to repair or replace the SSV. Such an intervention operation involves a semi-submersible drilling vessel which is deployed to the well and anchored in position. After removal of the cap 16 from the tree 15, a unit including blow-out preventers and a riser is lowered and locked on to the tree such that a workstring may be assembled and lowered to retrieve the production tubing string 7 to the vessel for replacement of the SSV 7*v*. The production tubing string 7*v* must then be reinstalled. This kind of intervention operation is quite expensive having a cost in the tens of millions of or even over one hundred million dollars.

SUMMARY OF THE DISCLOSURE

The present disclosure generally relates to a failsafe subsurface controlled safety valve. In one embodiment, a failsafe subsurface controlled safety valve includes: a tubular housing; a closure member disposed in the tubular housing, wherein the closure member is movable between a closed position and an open position; an operating piston operable to move the closure member from the open position to the closed position.

In another embodiment, a failsafe subsurface controlled safety valve assembly includes: a tubular housing; a closure member disposed in the tubular housing, wherein the closure member is movable between a closed position and an open position; a trigger piston operable to move the closure member from the open position to the closed position; and a trigger assembly operable to actuate the trigger piston, wherein the trigger assembly is in fluid communication with a bore of the tubular housing.

A method for controlling fluid flow in a tubular housing of a subsurface safety valve, comprising: supplying pressure to the tubular housing to actuate an operating piston, thereby moving an opener from an upper position to a lower position; moving a closure member from a closed position to an open position in response to moving the opener to the lower position; maintain pressure in the tubular housing to retain the closure member in the open position; actuating a trigger piston, thereby moving the opener from the lower position to the upper position; and closing the closure member in response to moving the opener to the upper position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
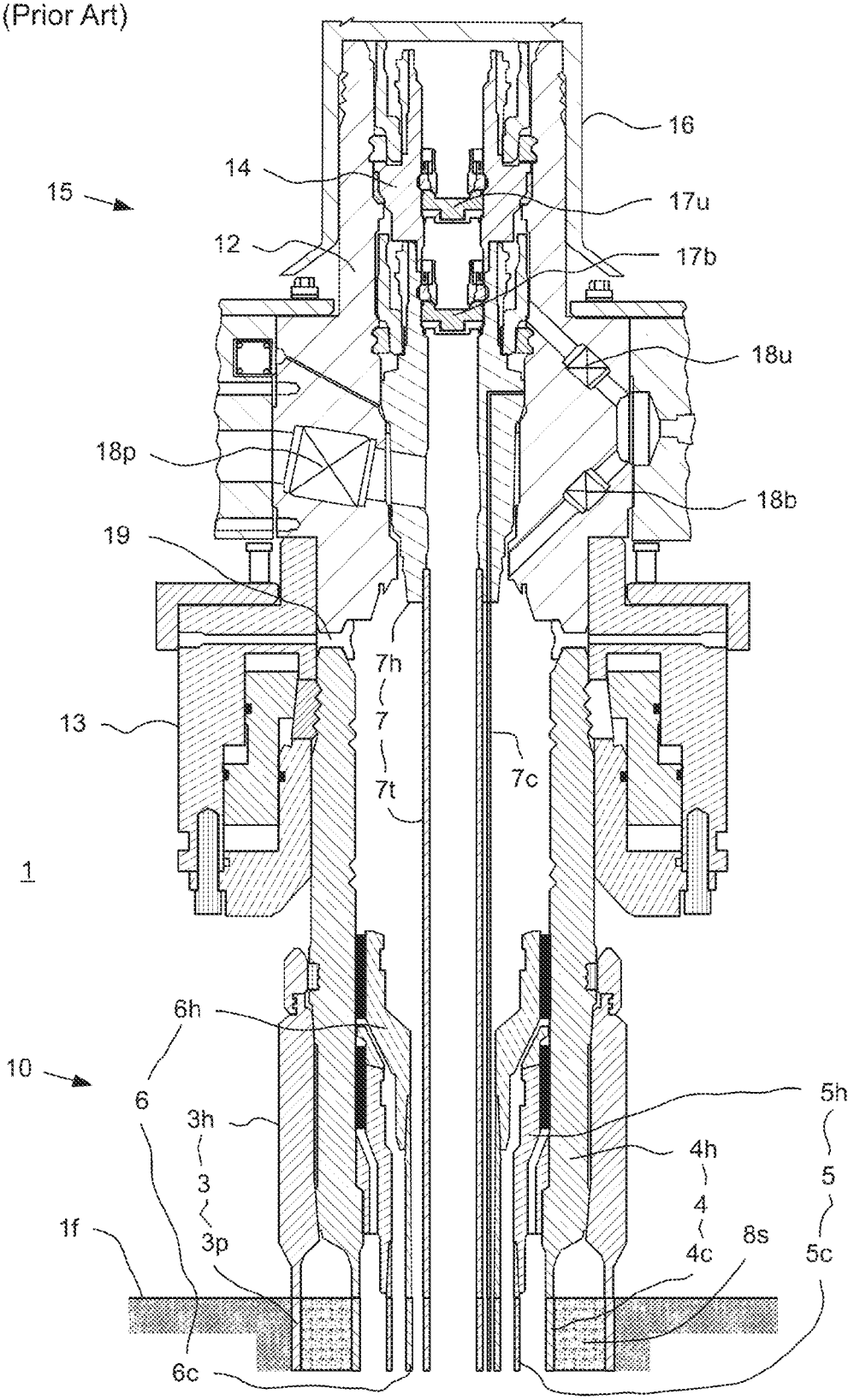
FIG. 1A (Prior Art)
FIGS. 1A-1C illustrate a prior art completed subsea well.
Figures 1B, 1C:
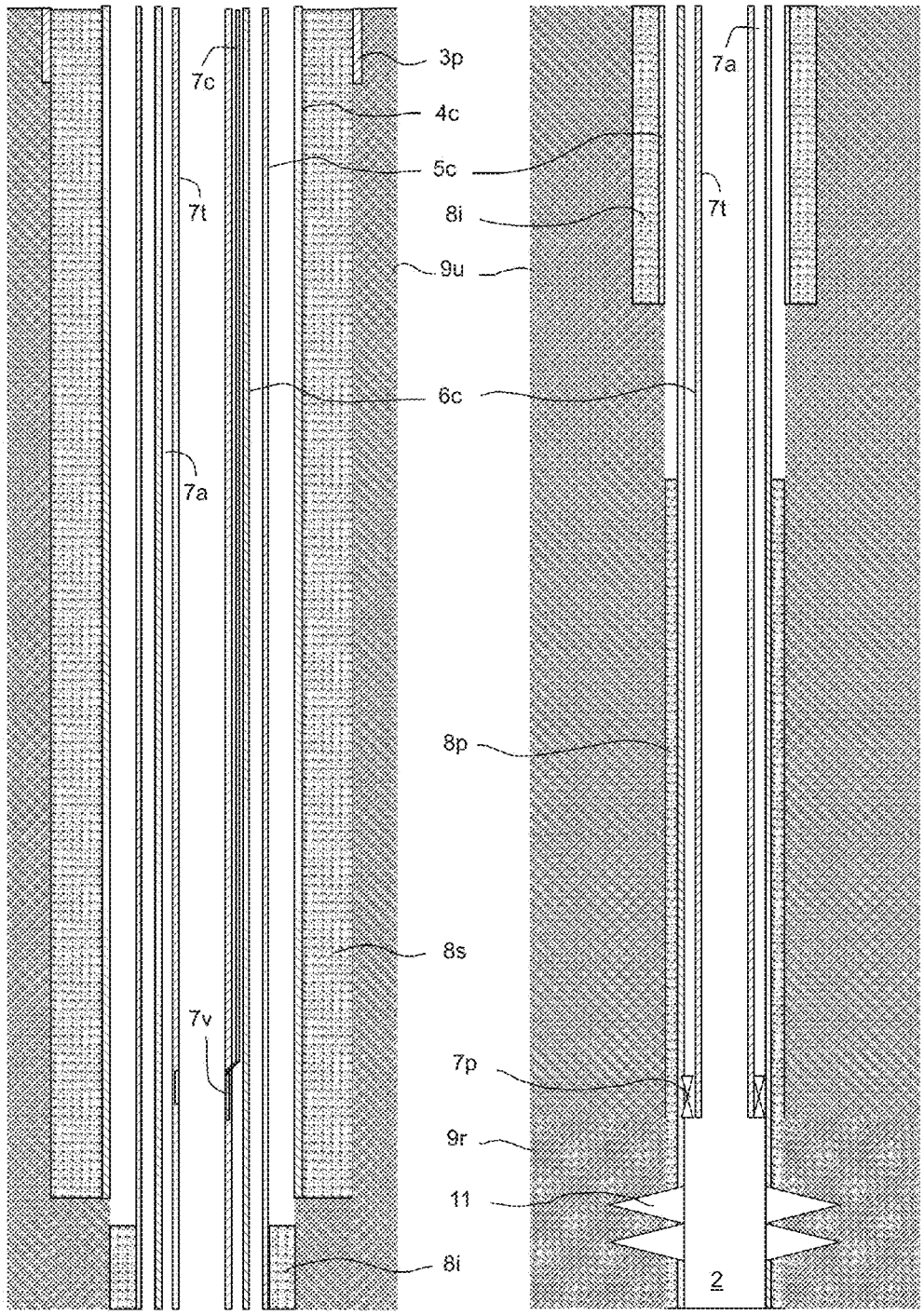
FIG. 1B (Prior Art)
FIG. 1C (Prior Art)
Figure 2A:
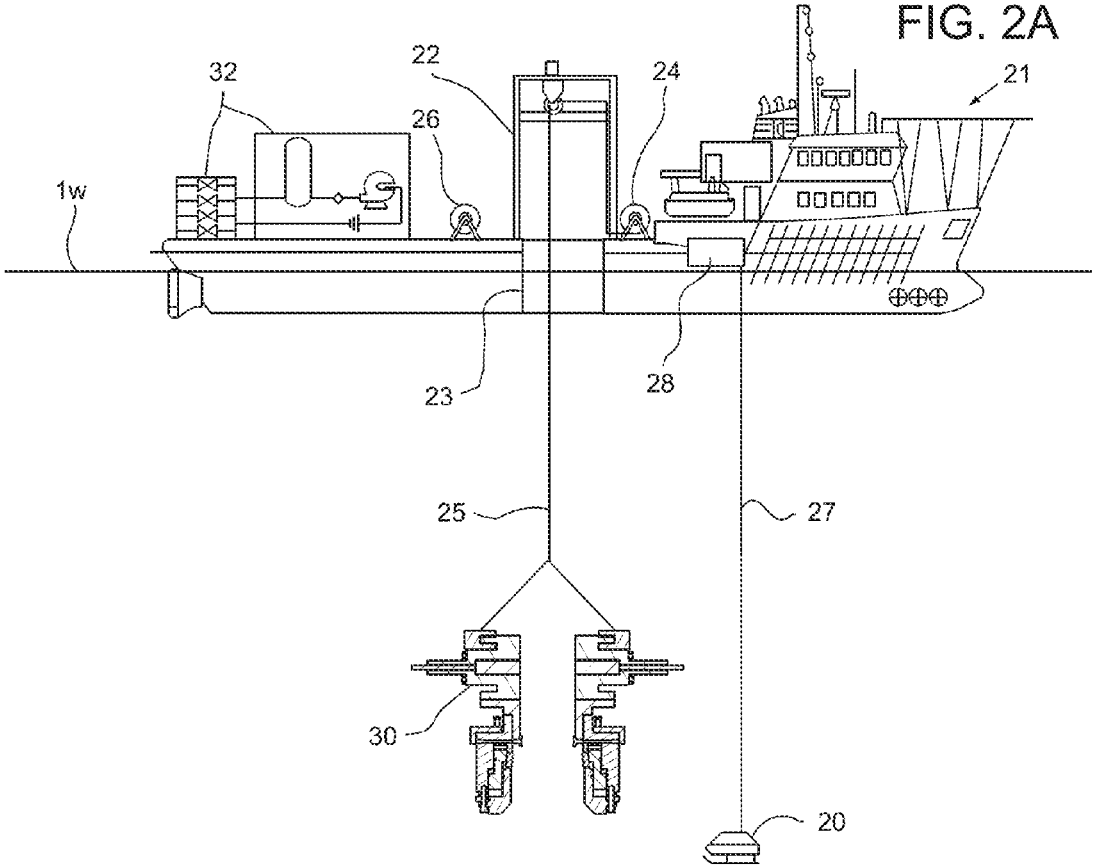
FIGS. 2A-2D illustrate riserless deployment of a failsafe subsurface controlled SSV to remediate a failed surface controlled SSV, according to one embodiment of the present disclosure.
Figure 2A:
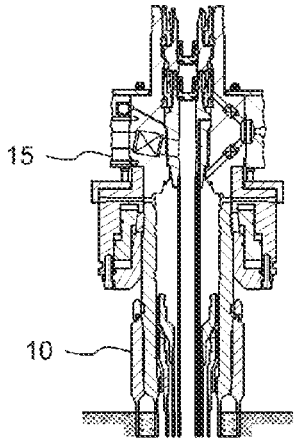
Figure 2B:
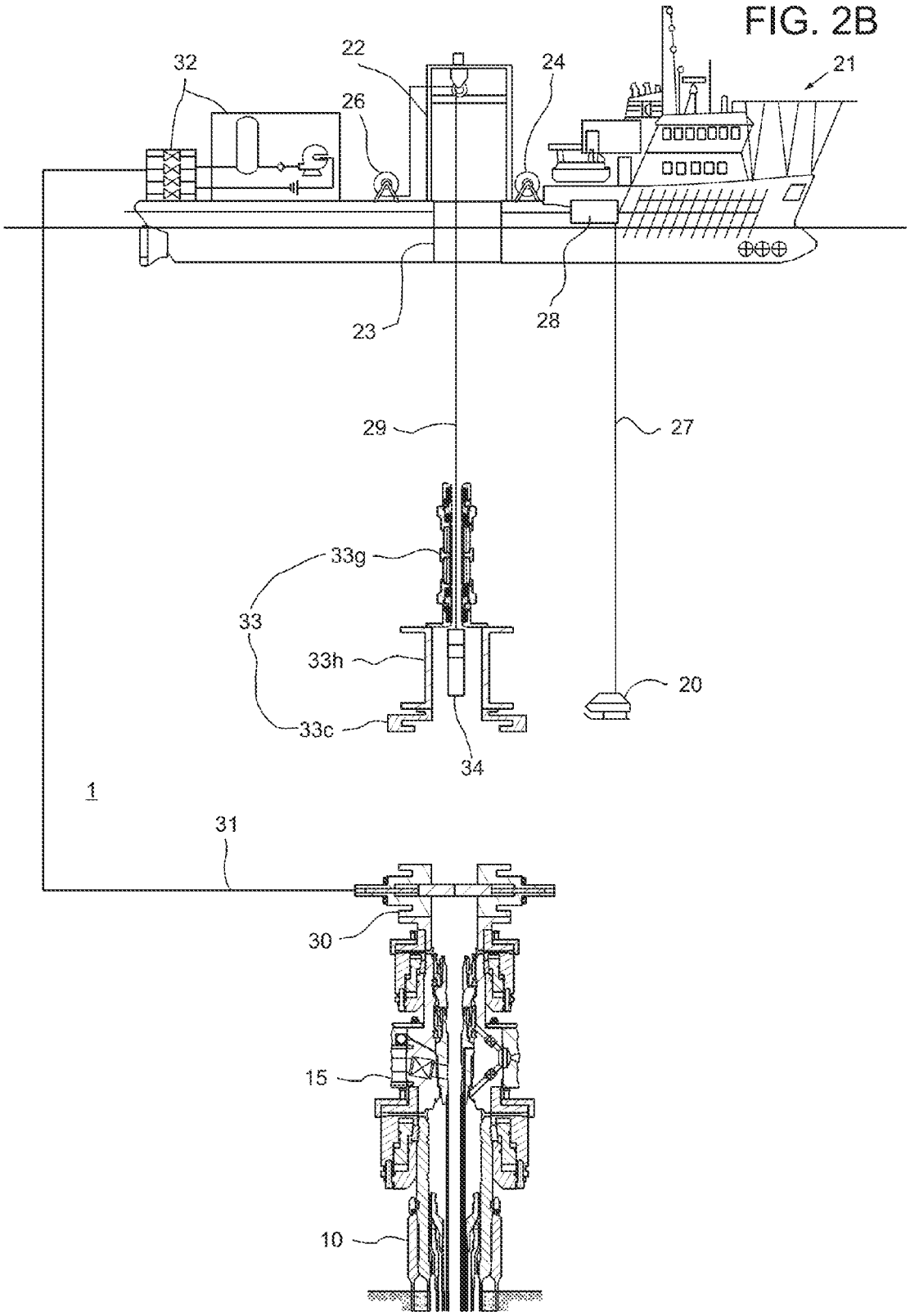
Figure 2C:
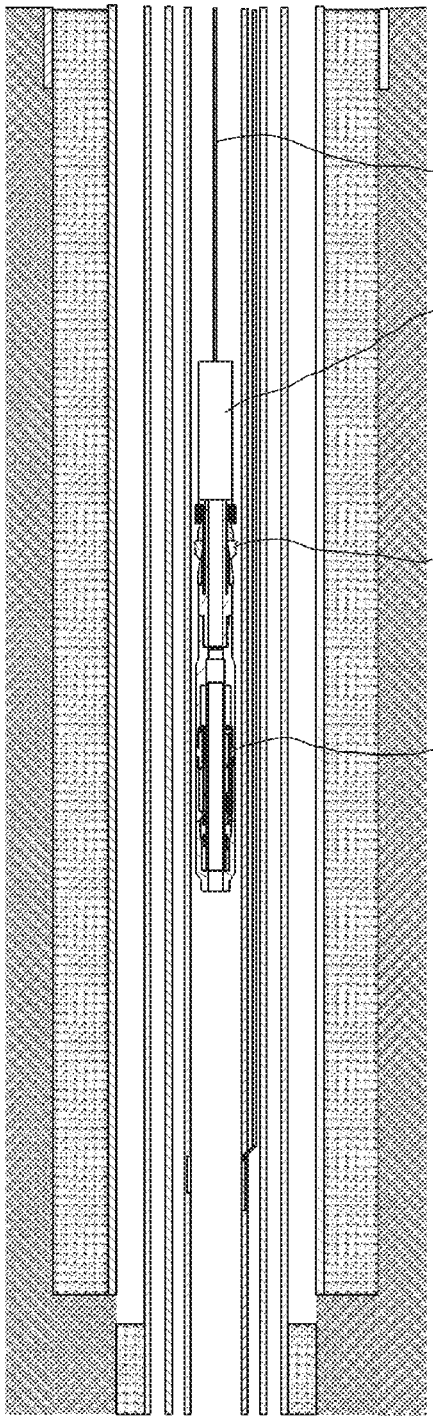
Figure 2D:
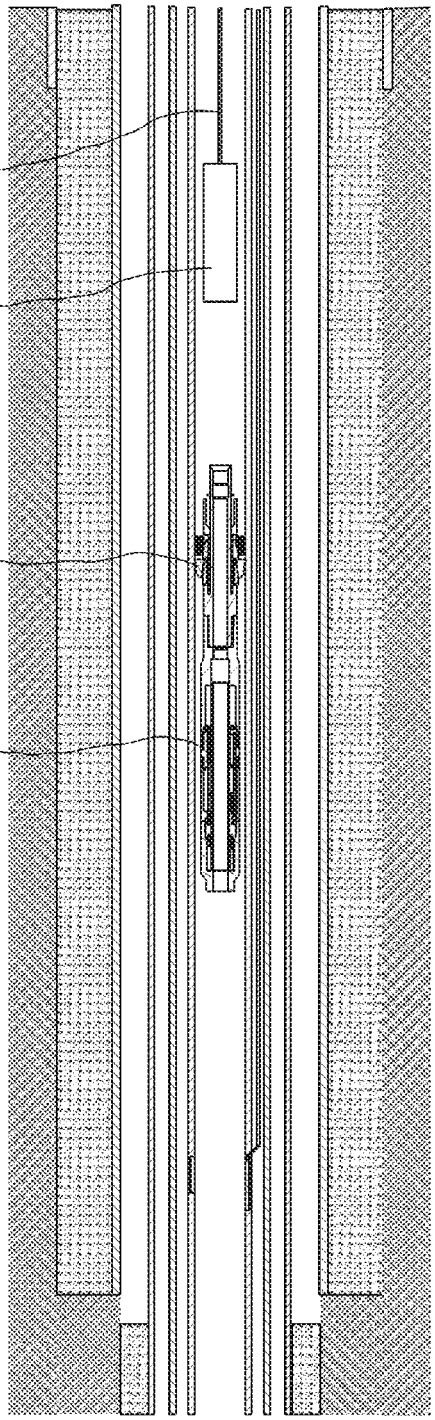

FIGS. 2A-2D illustrate riserless deployment of a failsafe subsurface controlled SSV 40 to remediate the failed surface controlled SSV 7*v*, according to one embodiment of the present disclosure. A support vessel 21 may be deployed to a location of the subsea tree 15. The support vessel 21 may be a light or medium intervention vessel and include a dynamic positioning system to maintain position of the vessel 21 on the waterline 1*w* over the tree 15 and a heave compensator (not shown) to account for vessel heave due to wave action of the sea 1. The vessel 21 may further include a tower 22 located over a moonpool 23 and a winch 24. The winch 24 may include a drum having wire rope 25 wrapped therearound and a motor for winding and unwinding the wire rope, thereby raising and lowering a distal end of the wire rope relative to the tower 22. The vessel 21 may further include a wireline winch 26.

Alternatively, a crane (not shown) may be used instead of the winch and tower.

The ROV 20 may be deployed into the sea 1 from the vessel 21. The ROV 20 may be an unmanned, self-propelled submarine that includes a video camera, an articulating arm, a thruster, and other instruments for performing a variety of tasks. The ROV 20 may further include a chassis made from a light metal or alloy, such as aluminum, and a float made from a buoyant material, such as syntactic foam, located at a top of the chassis. The ROV 20 may be connected to support vessel 21 by an umbilical 27. The umbilical 27 may provide electrical (power), hydraulic, and data communication between the ROV 20 and the support vessel 21. An operator on the support vessel 21 may control the movement and operations of ROV 20. The ROV umbilical 27 may be wound or unwound from drum 28.

The ROV 20 may be deployed to the tree 15. The ROV 20 may transmit video to the ROV operator for inspection of the tree 15. The ROV 20 may remove the external cap 16 from the tree 15 and carry the cap to the vessel 21. The ROV 20 may then inspect an internal profile of the tree 15. The wire rope 25 may then be used to lower a blowout preventer (BOP) stack 30 to the tree 15 through the moonpool 23 of the vessel 21. The ROV 20 may guide landing of the BOP stack 30 onto the tree 15 and operate a connector thereof to fasten the BOP stack to the tree. The ROV 20 may then deploy a control line 31 from a hydraulic power unit (HPU) 32 onboard the vessel 21 to the BOP stack 30 for remote operation thereof.

Alternatively, the winch 24 may be used to transport the external cap 16 to the waterline 1*w*.

A plug retrieval tool (PRT) (not shown) may then be inserted into a lubricator 33 for deployment through the moonpool 23 using the wireline winch 26. The lubricator 33 may include a seal head 33*g* having one or more stuffing boxes and a grease injector, a tool housing 33*h*, and a connector 33*c*. The lubricator 33 may be landed on the BOP stack 30 and fastened thereto by the ROV 20. The ROV 20 may then deploy a second control line (not shown) from the HPU 32 to the seal head 33*g* for remote operation of the stuffing boxes and a third control line (not shown) from a grease unit (not shown) onboard the vessel 21 to the seal head for operation of the grease injector. The PRT may be released from the lubricator 33 and electrical power supplied to the PRT via the wireline 29, thereby operating the PRT to remove the crown plugs 17*u,b*.

Once the crown plugs 17*u,b* have been removed from the tree 15, a bottomhole assembly (BHA) 34 may then be inserted into the lubricator 33 for deployment through the moonpool 23 using the wireline winch 26. The BHA 34 may include a setting tool 35, an anchor 36, and the failsafe subsurface controlled SSV 40. The lubricator 33 may be again landed on the BOP stack 30, fastened thereto by the ROV 20, and the ROV may reconnect the control lines for operation thereof. The BHA 34 may be released from the lubricator 33, lowered along the production tubing 7*t* to a desired depth, and electrical power supplied to the setting tool 35 via the wireline 29, thereby setting slips of the anchor 36 against an inner surface of the production tubing 7 and expanding a packing element of the anchor into sealing engagement with the production tubing inner surface.

The setting tool 35 may then be retrieved to the lubricator 33 and the lubricator retrieved to the vessel 21. The PRT may then be redeployed to the BOP stack 30 and the crown plugs 17*u,b* installed into the tree 15. The BOP stack 30 may then be retrieved to the vessel 21 and the cap 16 installed onto the tree 15. The tree valves 18*u,b,p* may be opened and production of the well may be resumed safely with the failsafe subsurface controlled SSV 40 in place.

Figure 3A:
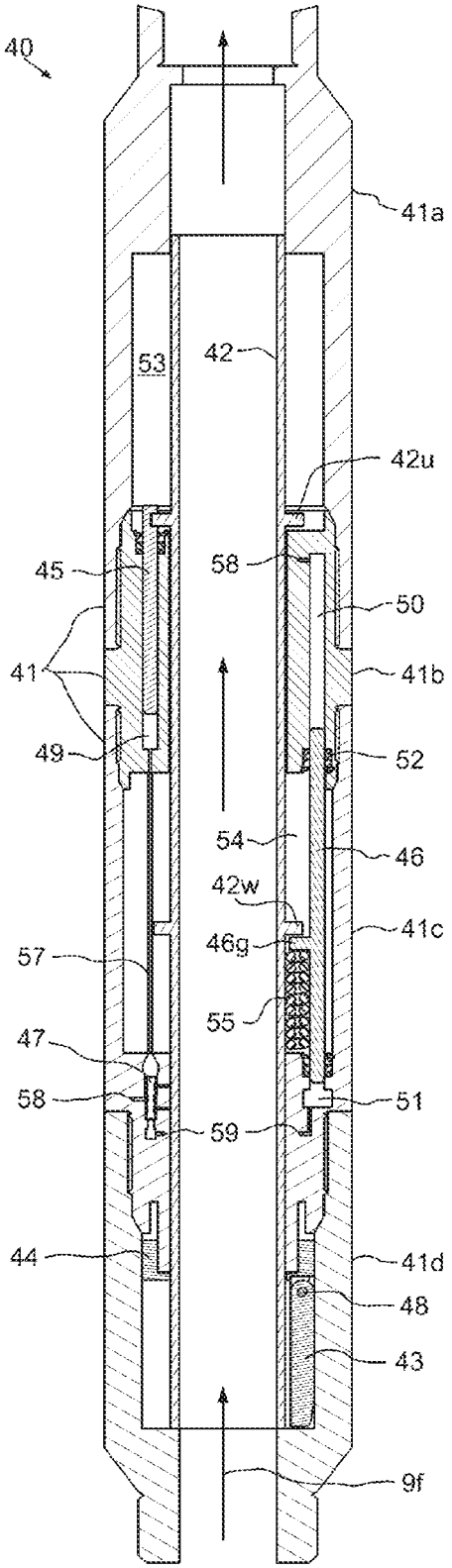
FIGS. 3A-3C illustrate the failsafe subsurface controlled SSV in an open position.
Figure 3B:
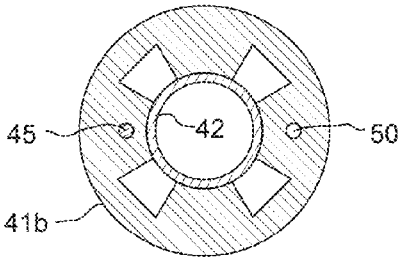
Figure 3C:
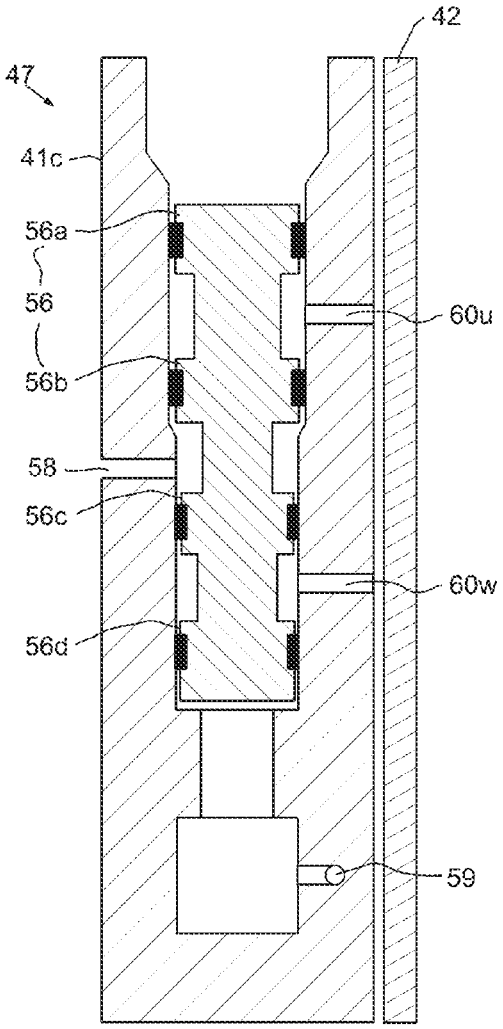

FIGS. 3A-3C illustrate the failsafe subsurface controlled SSV 40 in an open position. The SSV 40 may include a tubular housing 41, an opener, such as a flow tube 42, a closure member, such as a flapper 43, a seat 44, an operating piston 45, a trigger piston 46, and a trigger valve 47. To facilitate manufacturing and assembly, the housing 41 may include one or more sections 41*a-d* each connected together, such by threaded couplings and/or fasteners. The upper housing section may include a threaded coupling for connection to the anchor 36 and the lower housing section may include a threaded coupling for connection to a guide shoe (not shown). The SSV 40 may have a longitudinal bore therethrough for passage of the production fluid 9*f*. The seat 44 may be connected to the housing, such as by threaded couplings and/or fasteners.

Figure 4:
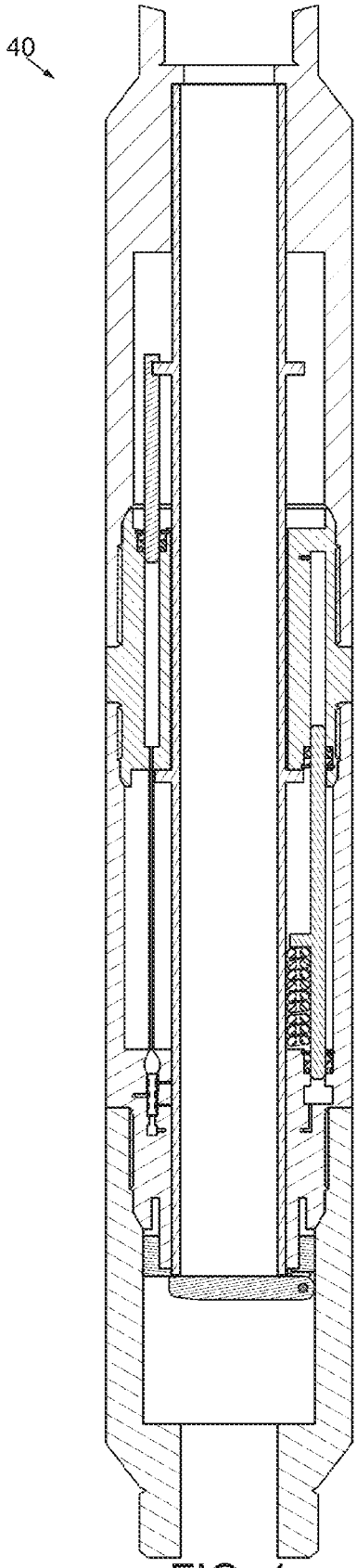
FIG. 4 illustrates the failsafe subsurface controlled SSV in a normally closed position.

The flow tube 42 may be disposed within the housing 41 and be longitudinally movable relative thereto between a lower position (shown) and an upper position (FIGS. 4 and 5). The flow tube 42 may have an upper flange 42*u* formed in an outer surface thereof and a lower flange 42*w* formed in the outer surface thereof.

The SSV 40 may further include a hinge 48. The flapper 43 may be pivotally connected to the seat 44 by the hinge 48. The flapper 43 may pivot about the hinge 48 between an open position (shown) and a closed position (FIGS. 4 and 5). The flapper 43 may be positioned below the seat 44 such that the flapper may open downwardly. An inner periphery of the flapper 43 may engage a respective seating profile formed in an adjacent end of the seat 44 in the closed position, thereby sealing an upper portion of the valve bore from a lower portion of the valve bore. The interface between the flapper 43 and the seat 44 may be a metal to metal seal. The hinge 48 may include a leaf, a knuckle of the flapper 43, a flapper spring, and a fastener, such as hinge pin, extending through holes of the flapper knuckle and a hole of each of one or more knuckles of the leaf. The seat 44 may have a recess formed in an outer surface thereof at an end adjacent to the flapper 43 for receiving the leaf. The leaf may be connected to the seat 44, such as by one or more fasteners. The flapper 43 may be biased toward the closed position by the flapper spring. The flapper spring may be a torsion spring wrapped around the hinge pin.

The flapper 43 may be opened and closed by interaction with the flow tube 42. Downward movement of the flow tube 42 may engage a bottom thereof with the flapper 43, thereby pushing and pivoting the flapper to the open position against the torsion spring due to engagement of the flow tube bottom with an inner surface of the flapper. Upward movement of the flow tube 42 may disengage the lower sleeve thereof with the flapper 43, thereby allowing the torsion spring to push and pivot the flapper to the closed position due to disengagement of the flow tube bottom from the inner surface of the flapper.

The lower housing section 41*d* may have a cavity formed in an inner surface thereof. When the flow tube 42 is in the lower position, a flapper chamber may be formed radially between the lower housing section 41*d* and the flow tube and the (open) flapper 43 may be stowed in the flapper chamber. The flapper chamber may be formed longitudinally between the seat 44 and a shoulder of the lower housing section adjacent to the cavity. The flapper chamber may protect the flapper 43 and seat 44 from erosion and/or fouling by particulates in the production fluid 9*f*. The flapper 43 may have a curved shape to conform to the annular shape of the flapper chamber and a bottom of the seat 44 may have a curved shape complementary to the flapper curvature.

Protection of the flapper 43 and seat 44 in the flapper chamber results in a more robust valve than prior art storm chokes relying on poppets exposed to the flowing production fluid 9*f*.

The second housing section 41*b* may have an operating chamber 49 formed in and along a wall thereof and a trigger chamber 50 formed in and along a wall thereof. The second housing section 41*b* may have a seal receptacle formed in an upper end thereof adjacent to the operating chamber 49 and another seal receptacle formed in a lower end thereof adjacent to the trigger chamber 50. The third housing section 41*c* may have an atmospheric chamber 51 formed in a wall thereof and a seal receptacle formed therein adjacent to the atmospheric chamber. A sliding seal 52 may be disposed in each seal receptacle. The operating chamber 49 may be charged to a high pressure with a gas, such as nitrogen. The trigger chamber 50 may be charged to a medium pressure with a gas, such as nitrogen. The atmospheric chamber 51 may be sealed at a low atmospheric pressure.

Alternatively, the pistons 45, 46 may carry the sliding seals 52 instead.

The operating piston 45 may be a rod disposed in the operating chamber 49 and have a groove formed adjacent to a top thereof for receiving the upper flange 42*u*, thereby longitudinally connecting the operating piston and the flow tube 42. The upper housing section 41*u* may have an operating cavity 53 formed in an inner surface thereof for accommodating movement of the operating piston 45 with the flow tube 42. A sliding interface formed between the flow tube 42 and the upper housing section may equalize pressure of the operating cavity 53 with a bore pressure of the SSV 40. The bore pressure resulting from the flowing production fluid 9*f* may exert a downward fluid force on the operating piston 45 tending to open the SSV 40. The high charge pressure in the operating chamber 49 may exert an upward fluid force on the operating piston 45 tending to close the SSV 40; however the high charge pressure may be selected to be less than the bore pressure of the SSV during normal production conditions.

The high charge pressure may be a percentage of the bore pressure during normal production conditions, such as seventy-five to ninety-five percent. The medium charge pressure may be a percentage of the bore pressure during normal production conditions, such as fifty to seventy-four percent.

Referring to FIG. 4, should control of the production fluid 9*f* be lost, such as by damage to the tree 15, the loss of backpressure exerted on the production fluid 9*f* and/or reduction in flowing pressure due to an increase in flow rate of the production fluid may correspondingly reduce the bore pressure of the SSV 40, thereby allowing the operating piston 45 to automatically move the flow tube 42 to the upper position so the flapper spring may close the flapper 43.

Referring back to FIGS. 3A-3C, the trigger piston 46 may be a rod having an upper portion disposed in the trigger chamber 50 and a lower portion disposed in the atmospheric chamber 51. The trigger piston 46 may have a lug 46*g* formed in a mid portion thereof adjacently below the lower flange 42*w*. The third housing section 41*c* may have a trigger cavity 54 formed in an inner surface thereof for accommodating extension of the trigger piston 46 between the trigger chamber 50 and the atmospheric chamber 51. The SSV 40 may further include a spring, such as a compression spring 55, disposed in the operating cavity 54 and having an upper end bearing against the lug 46*g* and a lower end bearing against a shoulder of the third housing section 41*c* adjacent to the operating cavity. The medium charge pressure in the trigger chamber 50 may exert a downward fluid force on the trigger piston 46 tending keep the lug 46*w* disengaged from the lower shoulder 42*w*. The compression spring 55 may exert an upward biasing force on the trigger piston 46 tending to engage the lug 46*w* with the lower shoulder 42*w* and close the SSV 40; however the biasing force may be selected to be less than the fluid force exerted on the trigger piston 46 by the medium charge pressure.

The trigger valve 47 may include a plug 56, a plug receptacle formed in the wall of the third housing section 41*c*, a pilot tube 57, a trigger passage 58, an atmospheric passage 59, and a pair of ports 60*u,w* extending between the plug receptacle and a sliding interface formed between the third housing section 41*c* and the flow tube 42. The plug 56 may have alternating seal shoulders 56*a-d* and recesses formed in an outer surface thereof and a seal may be carried by each seal shoulder and be engaged with the plug receptacle. The upper seal shoulders 56*a,b* may have a diameter greater than the lower seal shoulders 56*c,d*. A top of the plug 56 may be in fluid communication with the operating chamber 49 via the pilot tube 57. A bottom of the plug 56 may be in fluid communication with the atmospheric chamber 51 via the atmospheric passage 59. The upper and lower plug recesses may be in fluid communication with bore pressure of the SSV 40 via the respective ports 60*u,w* and equalization along the sliding interface between the flow tube 42 and the housing 41. The mid plug recess may be in fluid communication with the trigger chamber 50 via the trigger passage 58.

Figure 5A:
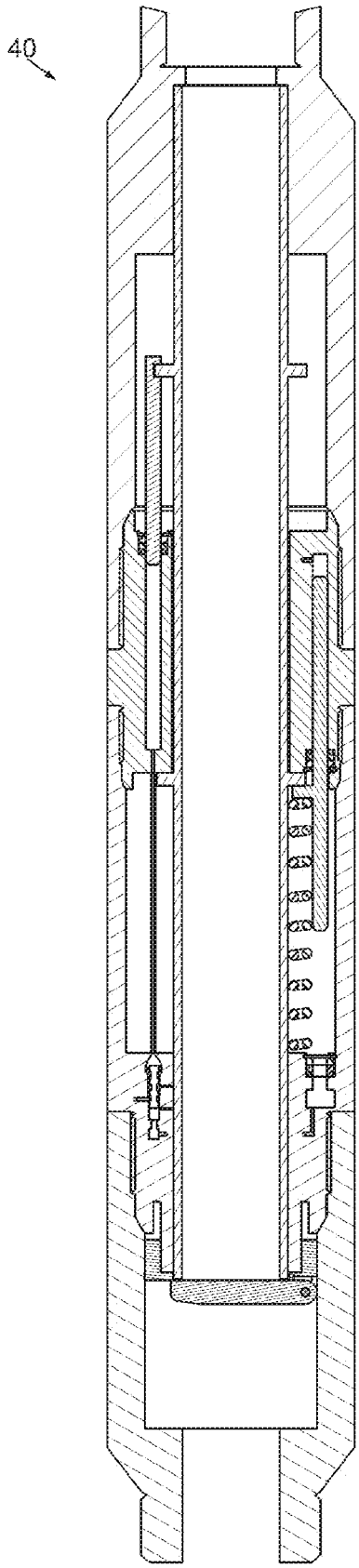
FIGS. 5A and 5B illustrate the failsafe subsurface controlled SSV in a failsafe closed position.
Figure 5B:
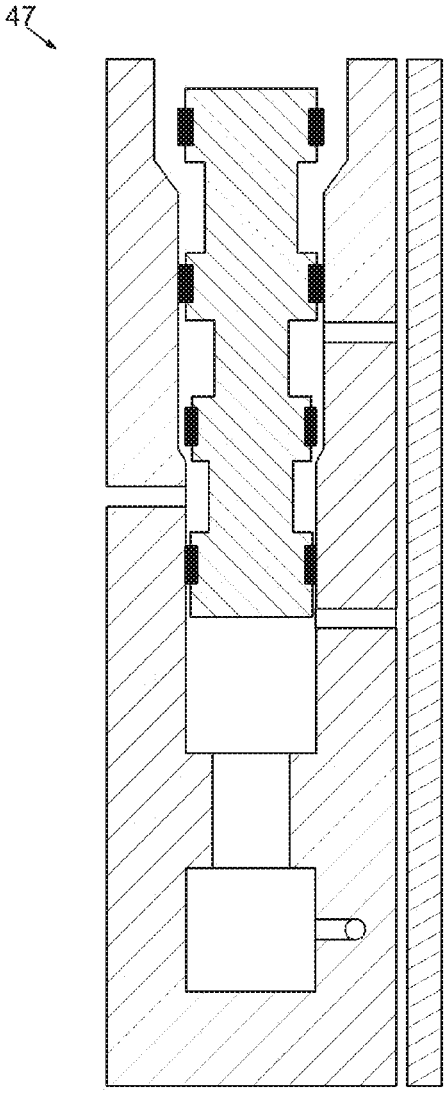

FIGS. 5A and 5B illustrate the failsafe subsurface controlled SSV 40 in a failsafe closed position. Should the nitrogen leak from the operating chamber 49, the medium pressure in the trigger chamber 50 may exert a net upward fluid force on the plug 56 due to the second seal shoulder 56*b* being larger than the third seal shoulder 56*c*. This upward force may move the plug 56 upward relative to the plug receptacle until the lower port 60*w* is exposed to the atmospheric passage 59 and the upper port 60*u* is exposed to the trigger passage 58. The trigger 50 and atmospheric 51 chambers may then equalize with the bore pressure of the SSV 40. This equalization negates the downward fluid force on the trigger piston 46 restraining the compression spring 55 in a compressed position. The compression spring 55 may then push the trigger piston 46 upward into engagement with the lower flange 42*w*. The compression spring 55 may continue to push both the trigger piston 46 and the flow tube 42 upward until the flow tube is in the upper position, thereby allowing the flapper spring to close the flapper 43.

Should failsafe closure occur, the SSV 40 may be retrieved in a reverse fashion to that of the deployment steps of FIGS. 2A-2D and replaced to resume production.

Alternatively, the trigger valve 47 may further include a lock (not shown) to retain the plug 56 in the open position (FIG. 5B) once the trigger valve has been activated. This lock may include a fastener, such as a snap ring, carried along an outer surface of the plug 56 for mating with a groove (not shown) formed in plug receptacle of the third housing section 41*c* at a location adjacent to the snap ring when the plug is in the open position. Engagement of the snap ring with the groove may prevent return of the plug 56 to the closed position (FIG. 3C).

Figure 6:
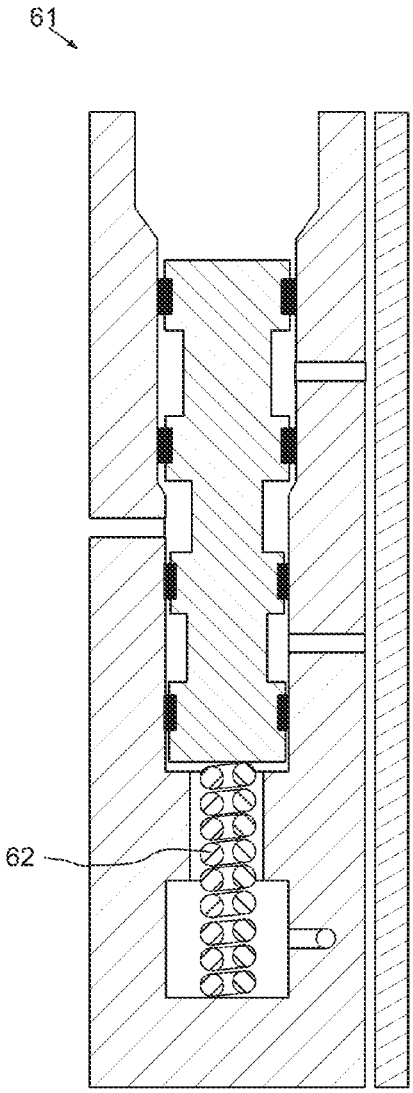
FIG. 6 illustrates an alternative trigger valve for the failsafe subsurface controlled SSV, according to another embodiment of the present disclosure.

FIG. 6 illustrate an alternative trigger valve 61 for the failsafe subsurface controlled SSV 40, according to another embodiment of the present disclosure. The alternative trigger valve 61 may further include a spring, such as a compression spring 62, bearing against a bottom of the plug 56 and a bottom of the plug receptacle. In the event that the nitrogen also leaks out of the trigger chamber 50, the compression spring 62 may provide the motive force to open the trigger valve 61.

Alternatively, the atmospheric chamber 51 and the trigger piston 46 may be lengthened such that a lower end of the trigger piston 46 remains in the atmospheric chamber when the SSV 40 is in the failsafe closed position.

Alternatively, the production tubing string 7 may have a nipple installed therein for receiving the SSV 40, thereby obviating the need for the anchor 36 or at least allowing for a simpler latch and seal to be used instead.

Alternatively, the trigger components and the operating piston and chamber may be located in a control sub located above a separate flapper valve sub and the flow tube may extend upward into the control sub.

Figure 7:
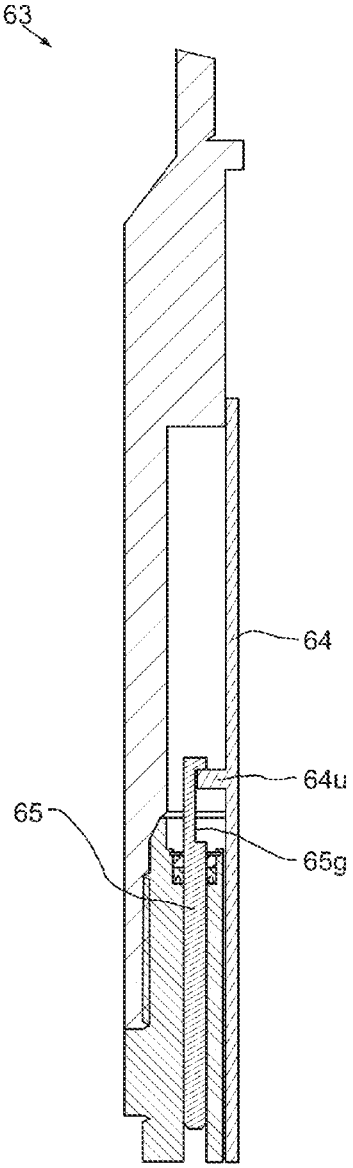
FIG. 7 illustrates an alternative failsafe subsurface controlled SSV, according to another embodiment of the present disclosure.

FIG. 7 illustrates an alternative failsafe subsurface controlled SSV 63, according to another embodiment of the present disclosure. The alternative failsafe SSV 63 may be similar to the SSV 40 except for having a slip joint formed between the operating piston 65 and the flow tube 64. The slip joint may include the upper flow tube flange 64*u* and a slot 65*g* instead of the groove connecting the operating piston 45 and the flow tube 42. The slip joint may allow limited upward movement of the operating piston 65 relative to the flow tube 64 before engaging and raising the flow tube by the operating piston, thereby allowing for transient pressure fluctuations in the bore pressure to pass without raising the flow tube and opening the flapper chamber.

Figure 8:
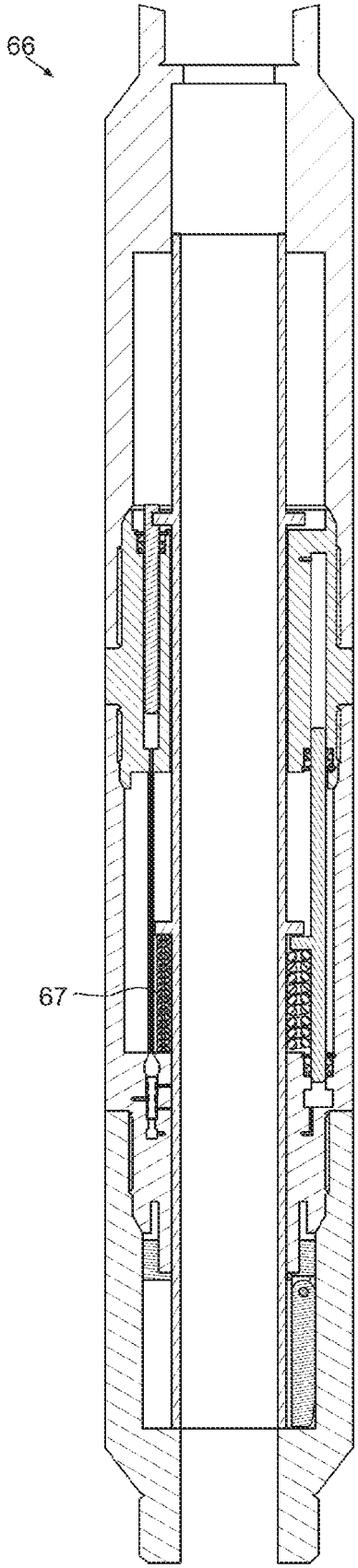
FIG. 8 illustrates an alternative failsafe subsurface controlled SSV, according to another embodiment of the present disclosure.

FIG. 8 illustrates an alternative failsafe subsurface controlled SSV 66, according to another embodiment of the present disclosure. The alternative failsafe SSV 66 may be similar to the SSV 40 except for the addition of a closure spring 67. The closure spring 67 may be a compression spring having an upper end bearing against a bottom of the lower flange 42*w* and a lower end bearing against the shoulder of the third housing section 41*c* adjacent to the operating cavity, thereby biasing the flow tube 42 toward the upper position. The closure spring 67 may ensure closing of the SSV 66 in a scenario where production fluid 9*f* leaks into the operating chamber 49.

While the foregoing is directed to embodiments of the present disclosure, other and further embodiments of the disclosure may be devised without departing from the basic scope thereof, and the scope of the invention is determined by the claims that follow.

The invention claimed is:

1. A failsafe subsurface controlled safety valve assembly comprising:

a tubular housing having a bore therethrough;

a closure member disposed in the bore of the tubular housing, wherein the closure member is movable between a closed position and an open position;

an operating piston operable to move the closure member from the open position to the closed position, wherein the operating piston is in fluid communication with the bore of the tubular housing; and a trigger piston operable to move the closure member from the open position to the closed position, wherein the operating piston is independently movable from the trigger piston.

2. The failsafe subsurface controlled safety valve assembly of claim 1, further comprising a trigger assembly operable to actuate the trigger piston and movable between an open position and a closed position, wherein the trigger assembly is in fluid communication with the bore of the tubular housing and wherein the trigger assembly isolates the trigger piston from the operating piston in the closed position.

3. The failsafe subsurface controlled safety valve assembly of claim 2, wherein the trigger assembly further comprises:

a chamber;

a plurality of ports disposed in a sidewall of the chamber; and a plug disposed in the chamber, wherein the plug is in fluid communication with the plurality of ports.

4. The failsafe subsurface controlled safety valve assembly of claim 3, wherein the plug is longitudinally movable in the chamber between an open position and a closed position.

5. The failsafe subsurface controlled safety valve assembly of claim 4, wherein the trigger assembly further comprises a lock operable to retain the plug in the open position.

6. The failsafe subsurface controlled safety valve assembly of claim 4, wherein the trigger assembly further comprises a biasing member operable to bias the plug to the open position.

7. The failsafe subsurface controlled safety valve assembly of claim 3, wherein the plug isolates the operating piston from the trigger piston in the closed position.

8. The failsafe subsurface controlled safety valve assembly of claim 1, further comprising a biasing member operable to bias the trigger piston.

9. The failsafe subsurface controlled safety valve assembly of claim 1, wherein the operating piston comprises a slip joint.

10. The failsafe subsurface controlled safety valve assembly of claim 1, further comprising a chamber disposed between the tubular housing and an opener, wherein the closure member is disposed in the chamber when in the open position.

11. A failsafe subsurface controlled safety valve assembly comprising:

a tubular housing having a bore therethrough;

a closure member disposed in the bore of the tubular housing, wherein the closure member is movable between a closed position and an open position;

a trigger piston operable to move the closure member from the open position to the closed position;

an operating piston operable to move the closure member from the open position to the closed position; and a trigger assembly operable to actuate the trigger piston and movable between an open position and a closed position, wherein the trigger assembly is in fluid communication with the bore of the tubular housing and wherein the trigger assembly isolates the trigger piston from the operating piston when in the closed position.

12. The failsafe subsurface controlled safety valve assembly of claim 11, wherein the trigger assembly further comprises:

a chamber;

a plurality of ports disposed in a sidewall of the chamber; and a plug disposed in the chamber, wherein the plug is in fluid communication with the plurality of ports.

13. The failsafe subsurface controlled safety valve assembly of claim 12, wherein the plug is longitudinally movable in the chamber between an open position and a closed position.

14. The failsafe subsurface controlled safety valve assembly of claim 13, wherein the trigger assembly further comprises a lock operable to retain the plug in the open position.

15. The failsafe subsurface controlled safety valve assembly of claim 13, wherein the trigger assembly further comprises a biasing member operable to bias the plug to the open position.

16. The failsafe subsurface controlled safety valve assembly of claim 11, wherein the operating piston is in fluid communication with the bore of the tubular housing.

17. The failsafe subsurface controlled safety valve assembly of claim 11, further comprising an operating chamber disposed in the tubular housing, wherein the trigger assembly is configured to actuate the trigger piston in response to pressure loss in the operating chamber.

18. The failsafe subsurface controlled safety valve assembly of claim 15, wherein the operating piston comprises a slip joint coupled to an opener.

19. The failsafe subsurface controlled safety valve assembly of claim 11, further comprising a chamber disposed between the tubular housing and an opener, wherein the closure member is disposed in the chamber when in the open position.

20. A method for controlling fluid flow in a tubular housing of a subsurface safety valve, comprising:

supplying pressure to the tubular housing to actuate an operating piston, thereby moving an opener from an upper position to a lower position;

moving a closure member disposed in a bore of the tubular housing from a closed position to an open position in response to moving the opener to the lower position;

maintaining pressure in the tubular housing to retain the closure member in the open position;

isolating the operating piston from the trigger piston using a trigger assembly;

actuating the trigger piston, thereby moving the opener from the lower position to the upper position; and closing the closure member in response to moving the opener to the upper position.

21. The method of claim 20, further comprising moving a plug from a closed position to an open position in response to a reduction in pressure in an operating chamber.

22. The method of claim 21, further comprising actuating the trigger piston in response to moving the plug to the open position.

23. The method of claim 21, further comprising retaining the plug in the open position using a lock.

24. The method of claim 20, further comprising moving the closure member between an inner wall of the tubular housing and the opener when the closure member is in the open position.

* * * * *